United States Patent [19]

Caruso

[11] 4,173,088

[45] Nov. 6, 1979

[54] TOY GUN OF THE REVOLVER TYPE AND LAMINAR AMMUNITION THEREFOR

[76] Inventor: Anthony M. Caruso, Sarasota, Fla.

[21] Appl. No.: 825,588

[22] Filed: Aug. 18, 1977

[51] Int. Cl.[2] ..... F41C 3/06

[52] U.S. Cl. ..... 42/58; 102/281

[58] Field of Search ..... 42/58, 54; 102/86.5, 102/281

[56] References Cited

U.S. PATENT DOCUMENTS

| | | | |
|---|---|---|---|
| 2,027,117 | 1/1936 | Peake | 102/86.5 |
| 2,046,652 | 7/1936 | Peake | 42/58 |
| 2,087,193 | 7/1937 | Jones | 42/58 |
| 3,225,480 | 12/1965 | Ferri et al. | 42/58 |
| 3,820,267 | 6/1974 | Replogle et al. | 42/58 |
| 3,999,485 | 12/1976 | Ferri | 102/86.5 |

FOREIGN PATENT DOCUMENTS

| | | | |
|---|---|---|---|
| 909184 | 4/1954 | Fed. Rep. of Germany | 42/58 |
| 2551123 | 5/1977 | Fed. Rep. of Germany | 102/86.5 |
| 1146268 | 5/1957 | France | 42/58 |
| 588986 | 2/1959 | Italy | 42/58 |
| 978114 | 12/1964 | United Kingdom | 42/58 |

*Primary Examiner*—Charles T. Jordan
*Attorney, Agent, or Firm*—J. Harold Nissen

[57] ABSTRACT

A toy gun of the revolver type which is capable of employing various types of ammunition and incorporating in the head of the cylinder a plurality of chambers having a rod in each chamber functioning as a percussion anvil for cup like ammunition, and including at least a perimetral non-circular shoulder inscribed in a polygon. The number of the sides of the polygon is a submultiple of the anvils to assure the angular positioning of a laminar ammunition. The laminar ammunition is a sandwich construction with explosive charges held between two layers and spaced from each other angularly and radially from the center so as to conform with the anvils of the gun and presents a profile of its external perimeter and/or of a central hole to complement a corresponding profiled shoulder associated with the cylinder head of the gun to position the charges on the anvils.

13 Claims, 11 Drawing Figures

FIG. 9
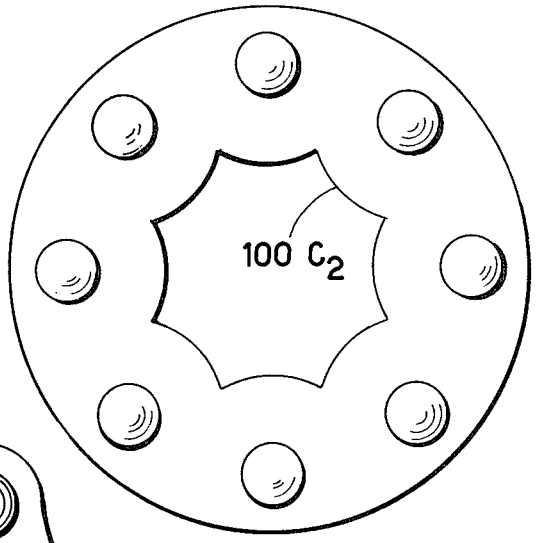
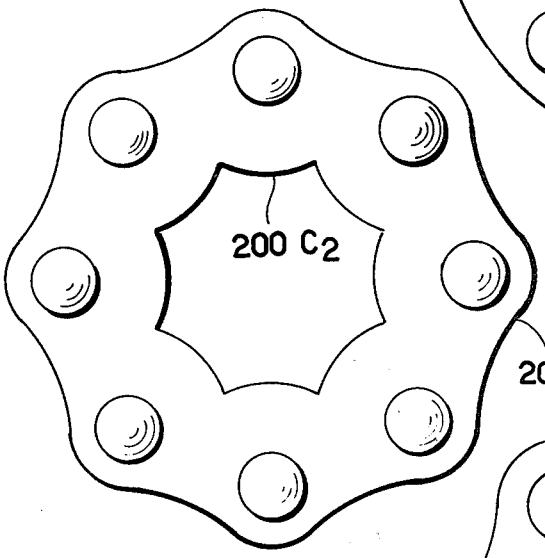
FIG. 10
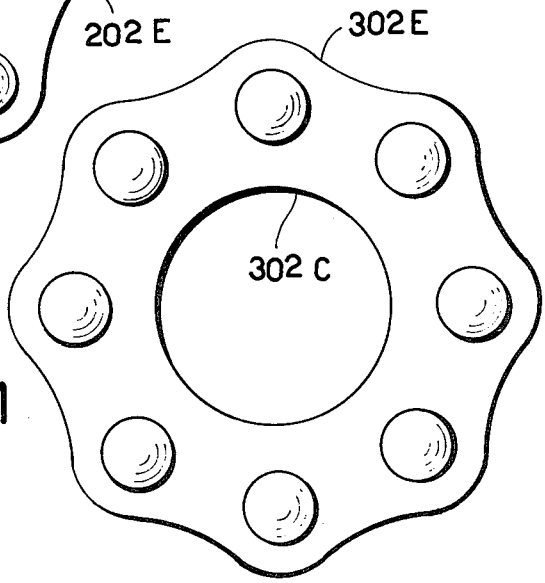
FIG. 11

TOY GUN OF THE REVOLVER TYPE AND LAMINAR AMMUNITION THEREFOR

BACKGROUND OF THE INVENTION

This invention relates to a toy gun of the revolver type and simply insertable multiple ammunition therefor.

More particularly, the invention pertains to a toy gun of the revolver type having a cylinder which incorporates a series of chambers with central anvils to accept and to fire various types of ammunition including cup type ammunition.

SUMMARY OF THE INVENTION

According to the invention, the toy gun includes at least one perimetral non-circular shoulder or edge inscribed within a polygon. The number of sides of the polygon is a submultiple of the number of the anvils to permit the angular positioning of a laminar paper ammunition which is shaped so that its charges will always conform to the geometry of the cylinder and be aligned with the anvils.

A non-circular boss or polygonal raised portion in the form of a central shoulder may also be located in the center of the gun cylinder.

In accordance with one feature of the invention, the cylinder has a recess for a rigid circular ammunition which is shaped in the form of a doughnut or torroid. The anvils are provided in chambers in the gun cylinder and extend slightly above the plane of the top surface of the walls of the chambers in which they are incorporated. The ammunition includes charges which are aligned with the anvils and placed between the anvils and the gun hammer to assure percussion or firing of the charges.

The cylinder is provided with recesses above the chambers into which the ammunition charges are to be placed. The recesses are suitable for use with different types of ammunition and ammunition holders. Specifically, the recesses can be used for rigid disc ammunition in addition to paper ammunition, and the cup type ammunition, whether in single caps or interlaced in a ring arrangement.

The seat for disc ammunition may be defined by an external polygonal shoulder circumscribing the perimeter of the disc ammunition.

One of the advantages in using the aforesaid cylinder is that it can be provided with one or more indexing means in the form of shoulders which extend from the top wall of the anvil chambers. The shoulders define therebetween the recesses and form a U-shaped chamber to receive the ammunition.

A further advantage is that the cylinder can be provided with a single indexing means in the form of a central axially extending raised portion forming part of the inner shoulder.

The internal shoulder as a further advantage may be provided with an external polygonal configuration, and to assure specific registry with the ammunition, the walls of the polygonal configuration may be arcuately-shaped. And, the external shoulder, in a similar manner may have its internal walls circumscribing a polygonal configuration in addition to being arcuately-shaped.

The profile of the sides of the polygons forming the shoulders may be curved to accentuate the cuspids at the vertices of the polygon.

The invention also pertains to a laminated paper ammunition substantially disc shaped, with charges sandwiched between two layers of paper. The charges are angularly spaced from each other, and they are displaced radially from the center and concentric therewith in order to coincide with the position of the anvils of the gun above described.

The paper ammunition includes a central hole and an outer profiled wall. The central hole may be circular or include a profiled wall. And, at least the central hole or the outer wall or both should be profiled to configurate with the inner shoulder or outer shoulder, respectively.

For this purpose the profile of the wall of the external perimeter of the laminar ammunition and/or the profile of the wall of the central hole are defined by a polygon to match the corresponding shoulder correspondingly shaped in the recess. The ammunition is housed or positioned in the recess in the gun cylinder, and therefore, one of the shoulders and the complementary profiled wall of the ammunition define the angular position of the ammunition with respect to the gun and its percussion anvils.

Other features and advantages of the invention will become readily apparent from the preferred embodiments of the invention illustrated in the drawings and described in the detailed description of the invention.

BRIEF DESCRIPTION OF THE DRAWINGS

FIG. 9 is a front view of a modification of the laminar ammunition of FIG. 7;

FIG. 10 is a front view of another modification of the ammunition of FIG. 7; and, FIG. 11 is a front view of another modification of the ammunition of FIG. 7.

DESCRIPTION OF THE PREFERRED EMBODIMENTS

Figure 1:
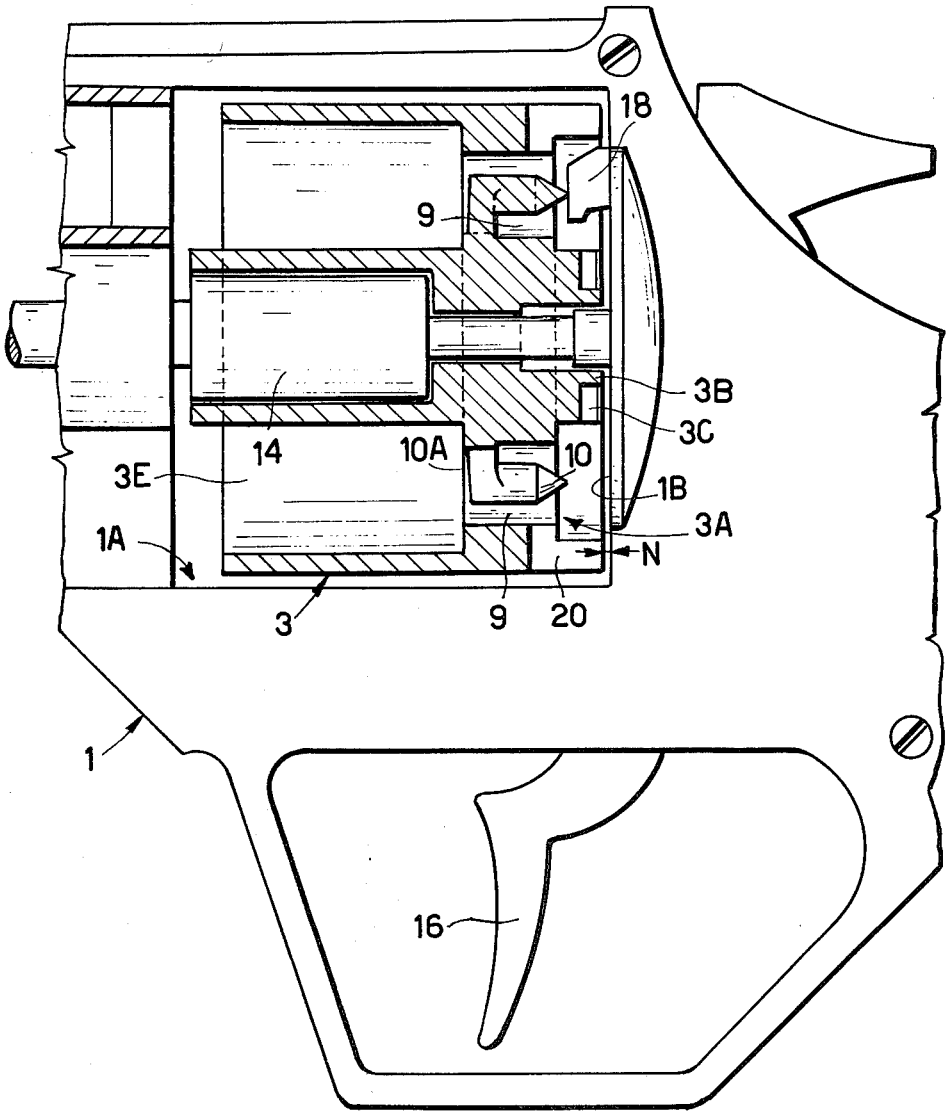
FIG. 1 is a partial view of a toy gun showing a complete view of an axially sectioned cylinder of the toy gun and its various components according to the invention.
Figure 3:
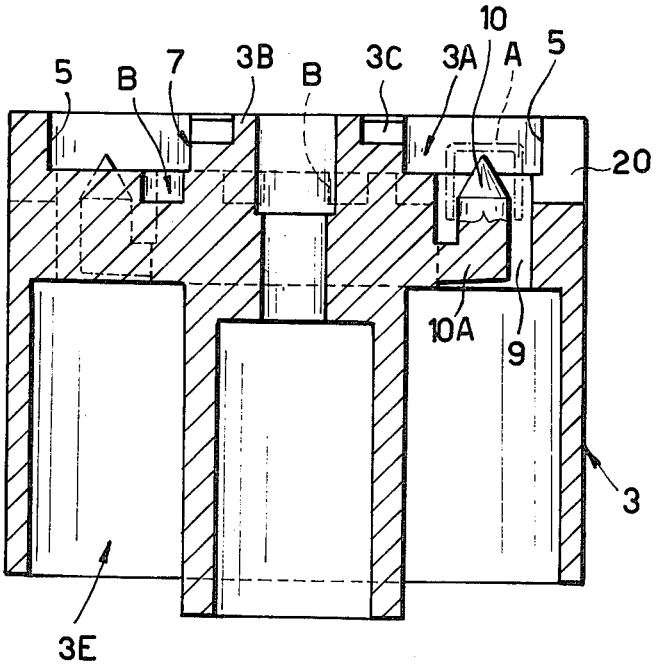
FIG. 3 is an axial section taken along III—III of FIG. 2.
Figure 2:
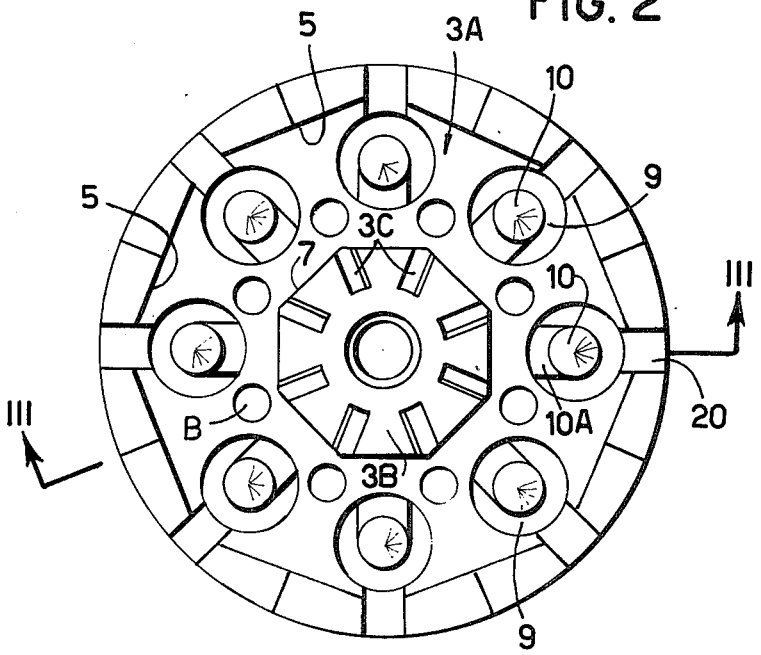
FIG. 2 is a front view of the cylinder looking in its axial direction and from the side of the ammunition seat.
Figure 8:
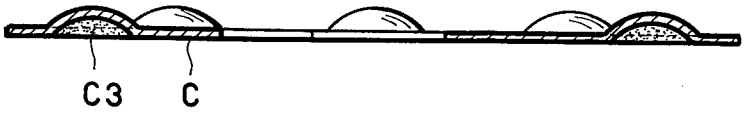
FIG. 8 is a sectional view taken along lines VIII—VIII of FIG. 7.
Figure 7:
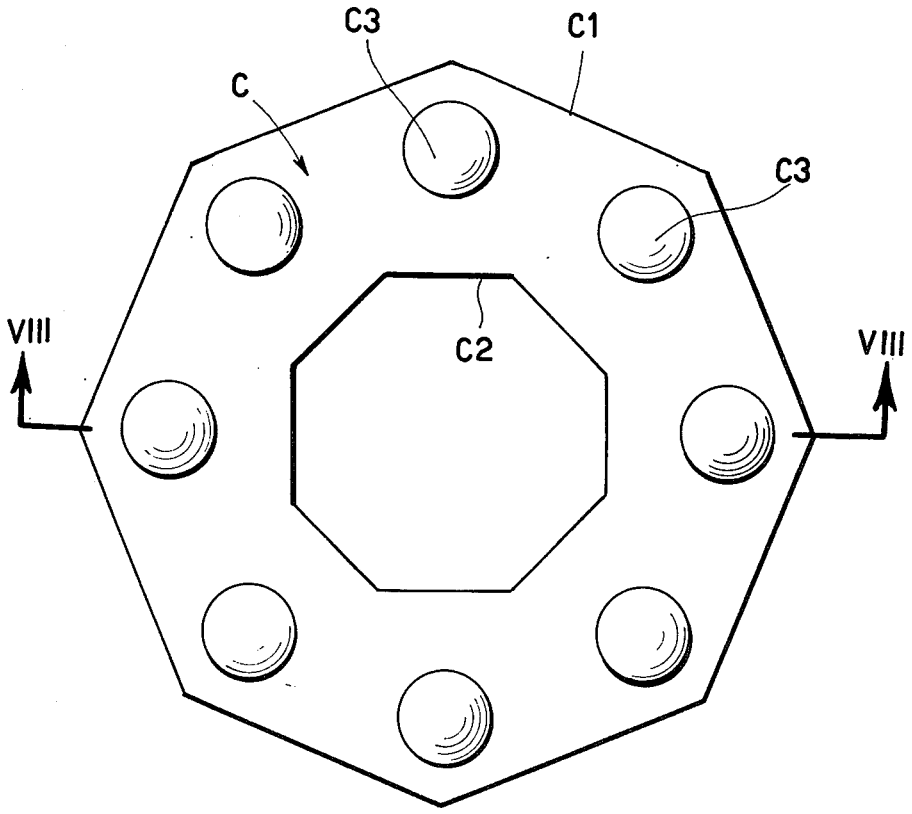
FIG. 7 is a frontal view of laminar ammunition more or less of paper products usable in conjunction with the gun cylinder of FIGS. 1 to 3.

Referring more particularly to FIGS. 1–3 and 7–8 of the accompanying drawings, toy gun 1 in FIGS. 1–3 is shown in combination with a laminar paper ammunition C of FIGS. 7 and 8.

Laminar ammunition C comprises a sandwich construction formed from an upper and a lower layer having a plurality of charge or ammunition holding areas to confine charge C3. Laminar construction C also includes an outer wall C1 and an inner wall C2 surrounding a central opening. Charges C3 are concentrically positioned relative to the central opening.

Referring again to FIGS. 1-3, toy gun 1 is provided with a recess 1A in which a movable and rotatable cylinder 3 is received. At the handle portion of the gun, breech surface 1B and hammer 18 are provided.

Cylinder 3 is provided with a recess 3A in its head portion. Recess 3A is surrounded by a shoulder 5 formed from a plurality of sides to form an inner wall having a polygonal configuration. Cylinder 3 is mounted so that it can swing-out laterally so as to permit the insertion or the removal of ammunition C. The gun may be also constructed so that it can break open along its axis for the same purpose.

The outer edge of the head of the cylinder 3 is spaced from the breech surface 1B by a distance N sufficiently limited or thin enough to prevent the laminar ammunition C placed onto the seat of the cylinder head from escaping.

The bottom of the annular recess 3A provides circular depressions or chambers to receive cup-type ammunition that are usable in conjunction with the gun involved.

Cylinder 3 includes a raised central portion forming an inner or central shoulder 7 which forms an inner wall of recess 3A. Positioned between inner shoulder 7 and outer shoulder 5 and connected with recess 3A is a chamber or depression 9. Cylindrical member 10 which acts as an anvil is connected to the central portion of cylinder 3 by web 10A.

Toy gun 1 includes a trigger 16 which is connected with the hammer 18 for actuation thereof. Toy gun 1 also includes a cylindrical stud 14 to mount cylinder 3 in recess 1A and center anvils 10 in registry with hammer 18 as trigger 16 in response to its activation rotates cylinder 3. In a conventional manner, a conventional pawl (not shown) cooperates with ratchet teeth 3C on cylinder 3 for rotation thereof with each percussion actuated by hammer 18.

The working end of anvil 10 is substantially conical or in any case tapered and protruding slightly above the plane of the recessed portion 3A which forms the top surface of the walls of chamber 9. Web 10A orginates from the central portion or nucleus aligned with shoulder 7 of the cylinder 3. The web 10A is relatively restricted much like the diameter of the anvil 10. Each chamber 9 includes a large through opening substantially semicircular in shape to permit the escape of the explosion gases into an annular cavity 3E incorporated in the cylinder; this in turn is open to the front of the gun so as to permit the evacuation of gases.

The shoulders 5 and 7, may also be considered to form a pair of rims surrounding the U-shaped chamber surrounding recess 3A, and through slot 20 is provided which is in communication with chamber 9 and recess 3A to permit the extraction of fired ammunition. Slots 20 may be of variable dimensions with some deeper than others. In fact, slots 20 may extend through the wall of chamber 9 and be below the top portion of anvil 10 as ammunition (or explosive charge) C3 is seated onto anvil 10.

With the cylinder thus constructed various types of ammunition may be loaded and fired.

Cup type ammunition A such as shown by broken lines in FIG. 3 may be fired, whether individual or attached to one another in ring or crown form. This ammunition is molded from synthetic resins in accordance with known art.

Disc-type ammunition embodying a central hole, corresponding to a section in correspondence with raised portion 3B, may be fired. The external diameter of the disc ammunition is not greater than the internal circumferential periphery inscribed by a polygon bounded by rim or shoulder 5, and the diameter of the central hole is at least equal to the outer circumference circumscribed about the polygon or shoulder 7. Hole seats as indicated by letter B are incorporated in the cylinder head to receive centering pins (not shown) constructed in the above mentioned disc ammunition.

Laminar paper ammunition C may also be used. Ammunition C which is in the form of a sandwich construction is provided with an external polygonal profile equal to the internal profile of the wall defined by rim 5 of recess 3A and a central hole with polygonal profile corresponding to the external profile of the wall of shoulder 7 of raised portion 3B.

Referring again to FIGS. 7 and 8, laminar paper ammunition C presents the external polygonal profile C1 and the internal polygonal profile C2. Explosive charges C3 are so arranged as to correspond with anvils 10 when the ammunition C is inserted in the depression 3A in a position which is defined by the polygonal profiles of rim 5 and shoulder 7.

The paper ammunition C or equivalent may be arranged with only an external configurated polygonal profile C1, or only an internal configurated polygonal profile C2 or both for greater positioning accuracy.

The ammunition C on being inserted more or less spontaneously aligns itself with said polygonal profiles in rim 5 and/or shoulder 7 or both without difficulty. Profile C1 or C2 insures the centering of the explosive charges C3 in correspondence with the anvils 10 which operate in conjunction with the hammer 18 to explode and simulate the noise of a gun. With this arrangement, and the use of cylinder 3, it is possible practically to achieve the feasibility to fire any type ammunition available on the market.

Figure 5:
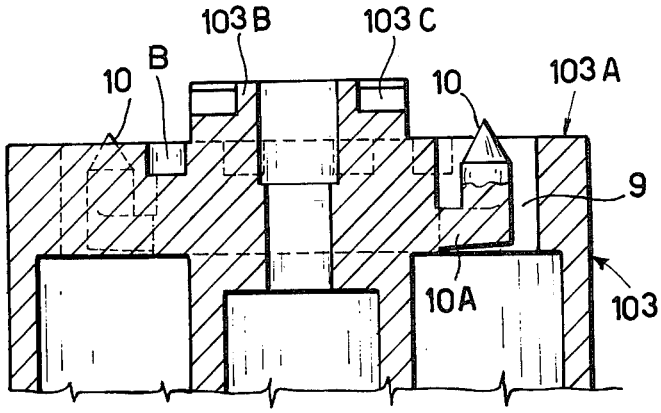
FIG. 5 is a sectional view of the cylinder of FIG. 4, similar to the sectional view of FIG. 3.
Figure 4:
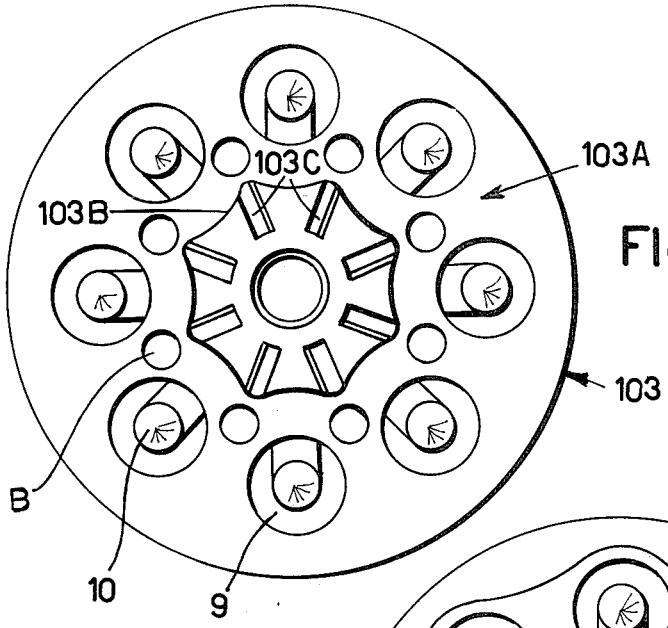
FIG. 4 is a view similar to FIG. 2 illustrating a modification of the cylinder of FIG. 2.

Referring now to FIGS. 4 and 5, there is shown a cylinder 103 which is a modification of cylinder 3. Cylinder 103 omits shoulder or rim 5 and through slot 20 therethrough. Cylinder 103 includes a bottom surface 103A which is a continuation of the top surface of the walls of chamber 9. Bottom surface 103A is not bounded or surrounded by rim 5, and anvils 10 protrude from chambers 9. Raised member 103B is equivalent to 3B with ratchet teeth 103C analogous to 3C. The raised member 103B presents a periphery shaped so as to be circumscribed by a regular octagon, but having concave sides to accentuate the cuspids in correspondence with the vertices.

Raised member 103B forms part of the inner shoulder 7, and in this embodiment forms the sole indexing means for laminar ammunition C. This is in contrast to the FIGS. 1-3 embodiment in which shoulder 5 or shoulder 7 or both form the indexing means for ammunition C.

Referring now to FIGS. 9 and 10, which show a modification of the paper ammunition of FIGS. 7 and 8, the laminar paper ammunition is shown with central hole $100C_2$ in FIG. 9 and central hole $200C_2$ in FIG. 10. Both central holes $100C_2$ and $200C_2$ are configurated to mate with and be complementary to the outer profiled wall of raised member 103B. As shoulder 5 has been elminated from cylinder 103, the outer peripheral wall can be of any suitable shape which fits the toy gun. And, the outer configuration is shown as circular in FIG. 9 and concave in FIG. 10.

Centering of the paper ammunition, as shown in FIG. 9 or FIG. 10 with cylinder 103 is assured, as it incorporates central hole $100C_2$ or $200C_2$, having a shape equal to that of raised member 103B.

Figure 6:
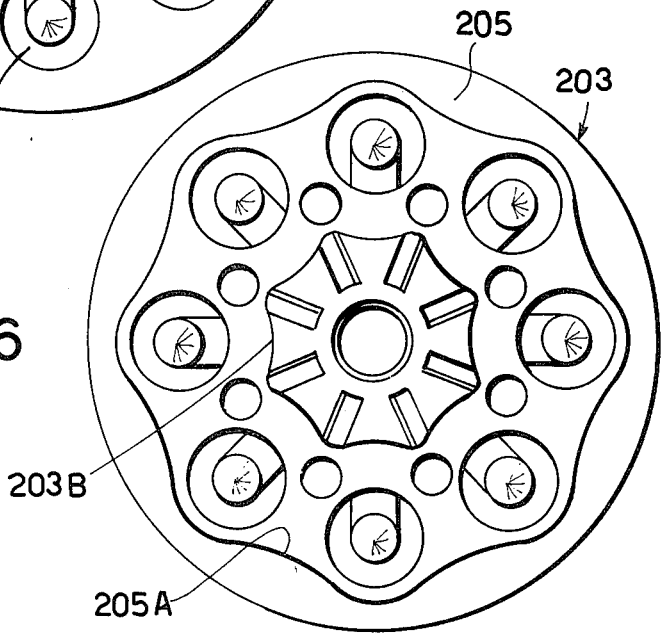
FIG. 6 is a view of another modification of the cylinder of FIG. 2.

Referring to FIG. 6 which shows a cylinder 203 which is a modification of cylinder 3. Cylinder 203 includes raised portion 203B similar to 103B and an external rim 205 similar to shoulder or rim 5. External rim 205 is provided with internal profile 205A shaped in the form of arcs that converge in correspondence with cuspids which coincide with the vertices of a regular geometrical polygon having eight sides circumscribed in the internal profile 205A. Raised portion 203B together with internal profile 205A form the indexing means for this embodiment. Raised portion 203B forms an external profile defined by arcuate or concavely curved walls, and internal profile 205A is formed from arcuate or convexly curved walls.

In FIG. 11, another modification of the laminar ammunition C is shown, and includes a central circular opening 302C and an outer perimeter or peripheral wall 302E. Wall 302E is provided with arcuate or concavely curved walls complementary to the walls of internal profile 205A.

With a cylinder like 203, ammunition shown in FIGS. 9, 10 and 11, may be employed. In FIGS. 10 and 11 the external wall profile 202E and 302E correspond to profile 205A of shoulder 205. The ammunition of FIG. 9 may also be utilized when its external diameter is not greater than the least circumference inscribed in the walls of profile 205A. For the laminar ammunition shown in FIG. 11, cylinder 203 is usable provided that the diameter of circular opening 302C has a diameter greater than the maximum diameter of raised portion 203B so that the raised portion 203B can be received within circular opening 302C, while wall 302E mates with internal profile 205A.

Moreover, the number of the sides and vertices of the polygon must be equal to the number of the explosive charges as well as the number of anvils or be submultiples of the charges and anvils, so that the charges of the paper ammunition will always correspond with the anvils of the cylinder. While the charges and anvils must be exactly equal, the number of sides or walls of the shoulders 5 and 7, and the external polygonal profile C1 and internal polygonal profile C2 can be a multiple of the number of anvils to assure proper indexing.

While there has been shown what is considered to be the preferred embodiments of the invention, it will be obvious that various changes and modifications may be made therein without departing from the scope of the invention.

I claim:

1. A toy gun of the repetitive action revolver-type capable of employing various types of laminar ammunition having charges, said toy gun including a rotatable cylinder head provided with a plurality of chambers, and a percussion anvil associated with each of said chambers for cup-like ammunition, the improvement comprising:

indexing means associated with said cylinder head including at least one shoulder having a plurality of perimetral sides, said shoulder extending from said cylinder head axially thereof and having a plurality of concave sides, said laminar ammunition having a central opening with a plurality of convex sides complementary to said concave sides for engagement therewith and positioning of the charges onto said anvils, and said plurality of perimetral sides being related to the number of said anvils in multiples thereof to assure angular positioning of a correspondingly-shaped laminar ammunition having charges equal to the number of said chambers centered onto said anvils.

2. The toy gun as defined in claim 1, wherein:

said indexing means including a second shoulder extending from said cylinder head outwardly of said anvils and having a plurality of convex sides, and said laminar ammunition having an outer peripheral perimeter with a plurality of concave sides complementary to said convex sides of said second shoulder.

3. The toy gun as defined in claim 1, wherein:

said cylinder head includes a recessed portion above said chambers to receive said charges, said anvils extend beyond the top surface of said chambers so that said charges lie on said anvils and thereby permit percussion of said charges.

4. The toy gun as defined in claim 1, wherein:

said cylinder head includes a seat portion on the top surface of said chambers to receive said laminar ammunition and a recessed portion above said chambers to receive said charges, and said anvils protrude beyond the top surface of the chambers of said cylinder head into said recessed portion thereof.

5. A toy gun of the repetitive action revolver-type capable of employing various types of laminar ammunition, said toy gun including a rotatable cylinder head provided with a plurality of chambers, and a percussion anvil associated with each of said chambers for cup-like ammunition, the improvement comprising:

indexing means associated with said cylinder head including two shoulders, at least one of said shoulders having a plurality of perimetral sides of non-circular configuration in a multiple of the number of said anvils, said laminar ammunition having a central opening and an outer peripheral portion, at least one of said central opening and said outer peripheral portion having a plurality of sides complemetary to at least one of said shoulders for engagement therewith, said plurality of perimetral sides being related to the number of said anvils in multiples thereof to assure angular positioning of a correspondingly-shaped laminar ammunition having charges equal to the number of said chambers centered onto said anvils.

6. The toy gun as defined in claim 5, wherein:

each of said shoulders includes a plurality of said non-circular sides forming a polygon, the sides of said central opening and said outer peripheral portion being non-circular and each forming a polygon complementary to the number of sides of said one and said other shoulders, respectively.

7. The toy gun as defined in claim 5, wherein:

both said shoulders have a plurality of perimetral sides of non-circular configuration in a multiple of the number of said anvils, one of said shoulders having its perimetral sides on an inner peripheral portion, and said other shoulder having its perimetral sides on an outer peripheral portion, said laminar ammunition having a central opening and an outer peripheral portion, one of the walls of said central opening and said outer peripheral portion having sides shaped complementary to said perimetral sides for engagement with one of said shoulders.

8. The toy gun as defined in claim 5, wherein:

one of said shoulders includes a plurality of sides forming a polygon, said laminar ammunition includes a paper carrier having a perimetral portion, and said perimetral portion includes a plurality of sides forming a polygon complementary to the number of sides of said one shoulder.

9. The toy gun as defined in claim 5, wherein:

said cylinder head includes a raised central portion, said non-circular shoulder being incorporated in said raised central portion.

10. The toy gun as defined in claim 5, wherein:

both of said shoulders have a plurality of perimetral sides of non-circular configuration in a multiple of the number of said anvils, all of said sides on said first and said second shoulders having portions partially arcuately-shaped, the walls of said central opening being partially arcuately-shaped for engagement with one of said shoulders and the walls of said outer peripheral portin being partially arcuately-shaped for engagement with the other of said shoulders, and said walls of said shoulders come together at points to form cuspids therebetween.

11. A laminar ammunition for use with a toy gun having a moveable cylinder provided with first and second spaced shoulders, at least one of said first and said second shoulders having sides in the form of a polygonal configuration and being non-circular and being a multiple of anvils associated with the cylinder, comprising:

a configurated sandwich construction formed from a pair of layers with discreetly placed ammunition charges therebetween, said sandwich construction having at least one wall of a polygonal configuration with non-circular sides complementary to the sides of said at least one of the first and second shoulders, and said one of said first and said second walls working together in conjunction with said at least one of said first and second shoulders to position the charge onto said anvils in the proper angular position with respect thereto.

12. The laminar ammunition as defined in claim 11, wherein:

said sandwich construction is provided with a central opening and one of said walls is an inner wall surrounding said central opening, and the other of said walls is an outer wall with said charges positioned between said walls.

13. The laminar ammunition as defined in claim 11, wherein:

said sandwich construction has an outer wall having a profile complementary to said second shoulder, and said sandwich construction has a central opening surrounded by an inner wall having a polygonal configuration and configurated from non-circular sides complementary to the sides of said first shoulder, said outer and said inner walls working in conjunction with said shoulders to position the charge onto said anvils in the proper angular position with respect thereto.

* * * * *